US011631527B2

(12) United States Patent
Kurobe

(10) Patent No.: US 11,631,527 B2
(45) Date of Patent: Apr. 18, 2023

(54) COIL COMPONENT AND METHOD FOR MANUFACTURING THE SAME

(71) Applicant: Murata Manufacturing Co., Ltd., Kyoto-fu (JP)

(72) Inventor: Junji Kurobe, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 642 days.

(21) Appl. No.: 16/195,508

(22) Filed: Nov. 19, 2018

(65) Prior Publication Data

US 2019/0180925 A1 Jun. 13, 2019

(30) Foreign Application Priority Data

Dec. 7, 2017 (JP) ..... JP2017-235385

(51) Int. Cl.
*H01F 27/29* (2006.01)
*H01F 27/24* (2006.01)
(Continued)

(52) U.S. Cl.
CPC ..... *H01F 27/29* (2013.01); *H01F 17/0006* (2013.01); *H01F 17/0013* (2013.01); *H01F 17/062* (2013.01); *H01F 27/24* (2013.01); *H01F 27/2804* (2013.01); *H01F 27/2895* (2013.01); *H01F 27/292* (2013.01); *H01F 27/32* (2013.01); *H01F 41/04* (2013.01); *H01F 41/10* (2013.01); *H01F 2017/002* (2013.01); *H01F 2027/2814* (2013.01)

(58) Field of Classification Search
CPC ..... H01F 27/29; H01F 27/24; H01F 27/32
USPC ..... 336/192
See application file for complete search history.

(56) References Cited

U.S. PATENT DOCUMENTS 3,185,947 A * 5/1965 Freymodsson ..... H05K 1/165 336/200
5,487,214 A * 1/1996 Walters ..... H01F 17/0006 29/602.1

(Continued)

FOREIGN PATENT DOCUMENTS

CN 103460376 A * 12/2013 ..... H01L 41/22
JP H07-122451 A 5/1995

(Continued)

OTHER PUBLICATIONS

An Office Action; "Notification of Reasons for Refusal," Mailed by the Japanese Patent Office dated Feb. 25, 2020, which corresponds to Japanese Patent Application No. 2017-235385 and is related to U.S. Appl. No. 16/195,508; with English language translation.

(Continued)

*Primary Examiner* — Elvin G Enad
*Assistant Examiner* — Joselito S. Baisa
(74) *Attorney, Agent, or Firm* — Studebaker & Brackett PC

(57) ABSTRACT

A coil component includes a main body portion containing resin, a coil provided in the main body portion, and an outer electrode electrically connected to the coil. A recess extending from a top surface of the main body portion toward a bottom surface thereof is provided in the side surface of the main body portion. The outer electrode is disposed in the recess, and a wall layer is interposed between the outer electrode and the inner surface of the recess.

18 Claims, 7 Drawing Sheets

(51) Int. Cl.

| | |
|---|---|
| ***H01F 27/32*** | (2006.01) |
| ***H01F 41/04*** | (2006.01) |
| ***H01F 17/00*** | (2006.01) |
| ***H01F 17/06*** | (2006.01) |
| ***H01F 27/28*** | (2006.01) |
| ***H01F 41/10*** | (2006.01) |

(56) References Cited

U.S. PATENT DOCUMENTS

| | | | | |
|---|---|---|---|---|
| 6,990,729 | B2 * | 1/2006 | Pleskach | H01F 17/0033 156/250 |
| 7,081,804 | B2 * | 7/2006 | Kitagawa | H01F 17/045 336/200 |
| 7,397,338 | B2 * | 7/2008 | Sano | H01F 17/043 336/192 |
| 7,791,445 | B2 * | 9/2010 | Manoukian | H01F 5/003 336/200 |
| 7,843,303 | B2 * | 11/2010 | Lu | H01F 17/0013 336/200 |
| 8,736,412 | B2 * | 5/2014 | Nishino | H01F 27/292 336/83 |
| 8,860,543 | B2 * | 10/2014 | Schaffer | H01F 27/2895 336/200 |
| 9,042,114 | B2 * | 5/2015 | Hattori | H05K 1/181 361/768 |
| 9,237,668 | B2 * | 1/2016 | Kojo | H01L 23/10 |
| 9,919,857 | B2 * | 3/2018 | Weissbrod | B65D 81/053 |
| 10,128,050 | B1 * | 11/2018 | Park | H05K 1/111 |
| 10,153,081 | B2 * | 12/2018 | Hirai | H01F 27/29 |
| 2003/0179062 | A1 * | 9/2003 | Kuwata | H01F 17/045 336/83 |
| 2006/0022788 | A1 * | 2/2006 | Sasamori | H01F 27/292 336/208 |
| 2011/0052970 | A1 * | 3/2011 | Kurata | H01M 50/593 429/158 |
| 2011/0291787 | A1 | 12/2011 | Dalmia et al. | |
| 2012/0119859 | A1 * | 5/2012 | Nishino | H01F 17/045 335/297 |
| 2014/0116768 | A1 * | 5/2014 | Hattori | H01G 4/228 174/260 |
| 2015/0091685 | A1 * | 4/2015 | Kitajima | H01F 17/0013 29/602.1 |
| 2017/0301460 | A1 * | 10/2017 | Ishida | H01G 4/005 |
| 2018/0019064 | A1 * | 1/2018 | Han | H01G 4/008 |
| 2019/0326047 | A1 * | 10/2019 | Yamaguchi | H01F 17/0013 |

FOREIGN PATENT DOCUMENTS

| | | | | |
|---|---|---|---|---|
| JP | H08-88122 | A | 4/1996 | |
| JP | H11-16746 | A | 1/1999 | |
| JP | 2003-332132 | A | 11/2003 | |
| JP | 2013-532375 | A | 8/2013 | |
| JP | 2016-207941 | A | 12/2016 | |
| JP | 6528075 | B2 * | 6/2019 | |
| WO | WO-2011155600 | A1 * | 12/2011 | H03H 9/0542 |
| WO | WO-2015029976 | A1 * | 3/2015 | H01F 17/0013 |

OTHER PUBLICATIONS

An Office Action; "Notice of Reasons for Refusal," mailed by the Japanese Patent Office dated Aug. 11, 2020, which corresponds to Japanese Patent Application No. 2017-235385 and is related to U.S. Appl. No. 16/195,508 with English language translation.

* cited by examiner

COIL COMPONENT AND METHOD FOR MANUFACTURING THE SAME

CROSS-REFERENCE TO RELATED APPLICATION

This application claims benefit of priority to Japanese Patent Application No. 2017-235385, filed Dec. 7, 2017, the entire content of which is incorporated herein by reference.

BACKGROUND

Technical Field

The present disclosure relates to a coil component and a method for manufacturing the same.

Background Art

An existing coil component is disclosed in Japanese Unexamined Patent Application Publication No. 2016-207941. This coil component has a case, a toroidal core housed in the case, a coil wound around the toroidal core, and an outer electrode provided on the bottom surface of the case and electrically connected to the coil.

SUMMARY

When the bottom surface of the above-described existing coil component is mounted on a mounting substrate, the outer electrode of the coil component is fixed to the mounting substrate by solder. However, only presence of the outer electrode on the bottom surface is not sufficient for an adhesion area of the solder, and there can be a problem in a fixing property. On the other hand, in manufacturing the above-described existing coil component, an assembly in which a plurality of coil components is arranged in a matrix is divided into individual pieces in normal cases. When the outer electrode is tried to be arranged on the side surface of the case in order to improve the fixing property, it becomes necessary to work up each coil component after the division, and manufacturing efficiency is deteriorated.

Accordingly, the present disclosure provides a coil component and a method for manufacturing the same, which can achieve both of improvement in a fixing property by a side electrode and upkeeping of manufacturing efficiency.

A coil component according to an aspect of the present disclosure includes a main body portion containing resin; a coil provided in the main body portion; and an outer electrode electrically connected to the coil. A recess extending from a top surface of the main body portion toward a bottom surface is provided in a side surface of the main body portion, the outer electrode is disposed in the recess, and a wall layer is interposed between the outer electrode and an inner surface of the recess.

Here, the bottom surface of the main body portion is a surface at a side along which the coil component is mounted on a mounting substrate.

With the coil component according to the aspect of the present disclosure, when the outer electrode of the coil component is fixed to the mounting substrate by solder and the bottom surface of the coil component is mounted on the mounting substrate, the outer electrode is disposed in the recess in the side surface of the main body portion. Therefore, the adhesion area of the solder can be secured and a fixing property can be improved. Further, since the outer electrode is provided on the wall layer in the recess of the main body portion, it is possible to provide the outer electrode with the side surface of the main body portion before division in manufacturing of the coil component. Therefore, manufacturing efficiency can be maintained.

In one embodiment of the coil component, the wall layer is substantially shaped along the inner surface of the recess. According to this embodiment, since the wall layer is not shaped to protrude to an outer side portion of the coil component, it is possible to suppress increase in size relative to an outer size of the main body portion.

In one embodiment of the coil component, the wall layer contains resin. According to this embodiment, since the wall layer contains resin, characteristics of the wall layer and the main body portion, such as coefficients of thermal expansion, can be the same, and close contact performance between the wall layer and the main body portion is made preferable.

In one embodiment of the coil component, the wall layer contains ceramic.

According to this embodiment, since the wall layer contains ceramic, characteristics of the wall layer and the outer electrode, such as coefficients of thermal expansion, can be approximated, and close contact performance between the wall layer and the outer electrode can be improved.

In one embodiment of the coil component, the coil includes an outer wiring exposed from at least one of a top surface and a bottom surface of the main body portion, and the outer electrode and the outer wiring are integrally continuous. According to this embodiment, since the outer electrode is integrally continuous with the outer wiring of the coil, there is no bonding surface between the outer electrode and the outer wiring and disconnection of the outer electrode and the outer wiring can be prevented.

In one embodiment of the coil component, an insulating protective sheet covering the outer wiring is further provided. According to this embodiment, it is possible to easily improve an insulating property of the outer wiring exposed from the main body portion.

Further, in one embodiment of the coil component, a substantially annular core provided in the main body portion is provided and the coil is wound around the core. According to this embodiment, the outer electrode on the side surface can be formed without reducing manufacturing efficiency in a toroidal coil that tends to be complicated in a manufacturing process.

In addition, one embodiment of a method for manufacturing a coil component according to another aspect of the disclosure includes: arranging at least a part of a coil in each of a plurality of regions partitioned by a cut line on a substrate; standing a pipe on the cut line on the substrate; and molding the coils and the pipe on the substrate with resin in a state of making an inside of the pipe be exposed. The method further includes forming an electrode film by plating in the pipe; and cutting the resin, the pipe, and the electrode film along the cut line on the substrate for division into the plurality of regions, and making the electrode film in the cut pipe be exposed to form outer electrodes.

According to the above embodiment, since the outer electrode can be disposed in a recess of the side surface of the main body portion formed of resin, reliability of connection of the coil component to the mounting substrate can be improved without increasing the mounting area of the coil component. Further, since a wall layer composed of the cut pipe can be interposed between the outer electrode and the inner surface of the recess, roughness of the inner surface of the recess of the main body portion can be absorbed by the wall layer and the thickness of the outer electrode can be uniformly reduced.

In addition, since the electrode film is formed by plating in the pipe, the outer electrodes in the plurality of regions can be formed at a time and manufacturing time can be shortened. Further, since the pipe is cut along the cut line on the substrate and the electrode film in the cut pipe is exposed to form the outer electrodes, the pipe and the electrode film are thin and stress at the time of cutting can be reduced.

In addition, in one embodiment of the method for manufacturing the coil component, in the forming the electrode film in the pipe, parts of the coils exposed from the resin are continuously formed integrally with the electrode film by plating. According to the above embodiment, since the parts of the coils are continuous with the electrode film (outer electrodes), there is no bonding surface between the coils and the outer electrodes and disconnection of the coils and the outer electrodes can be prevented.

Other features, elements, characteristics and advantages of the present disclosure will become more apparent from the following detailed description.

DETAILED DESCRIPTION

Hereinafter, one mode of the present disclosure will be described more in detail with reference to an illustrated embodiment.

Figure 1:
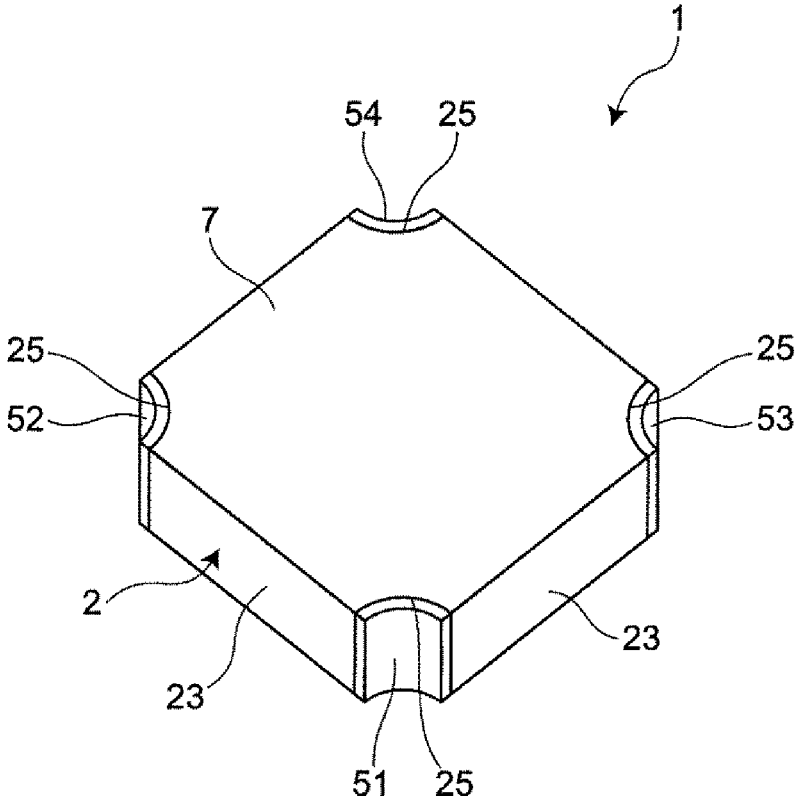
FIG. 1 is a perspective view illustrating a coil component as an embodiment of a coil component.
Figure 2:
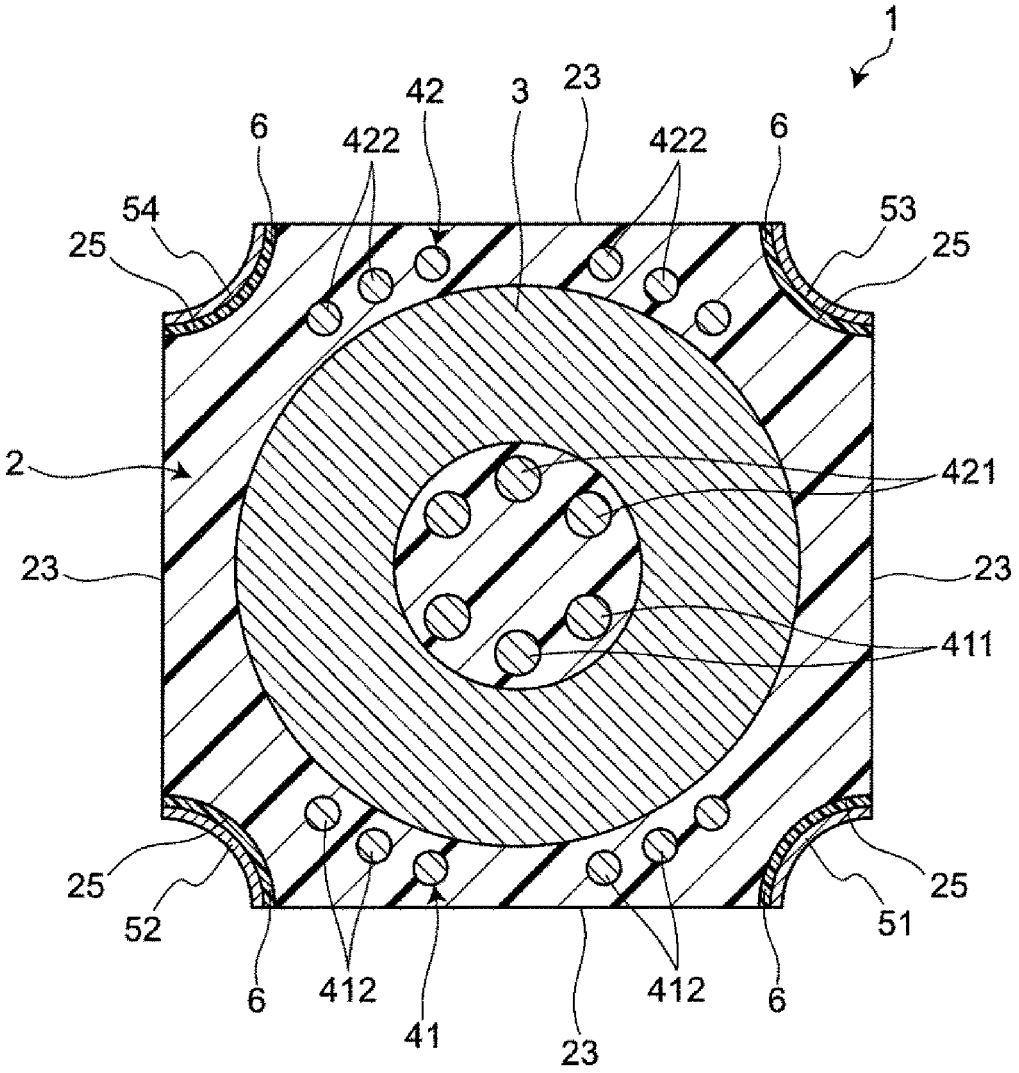
FIG. 2 is a cross-sectional view of the coil component.
Figure 3:
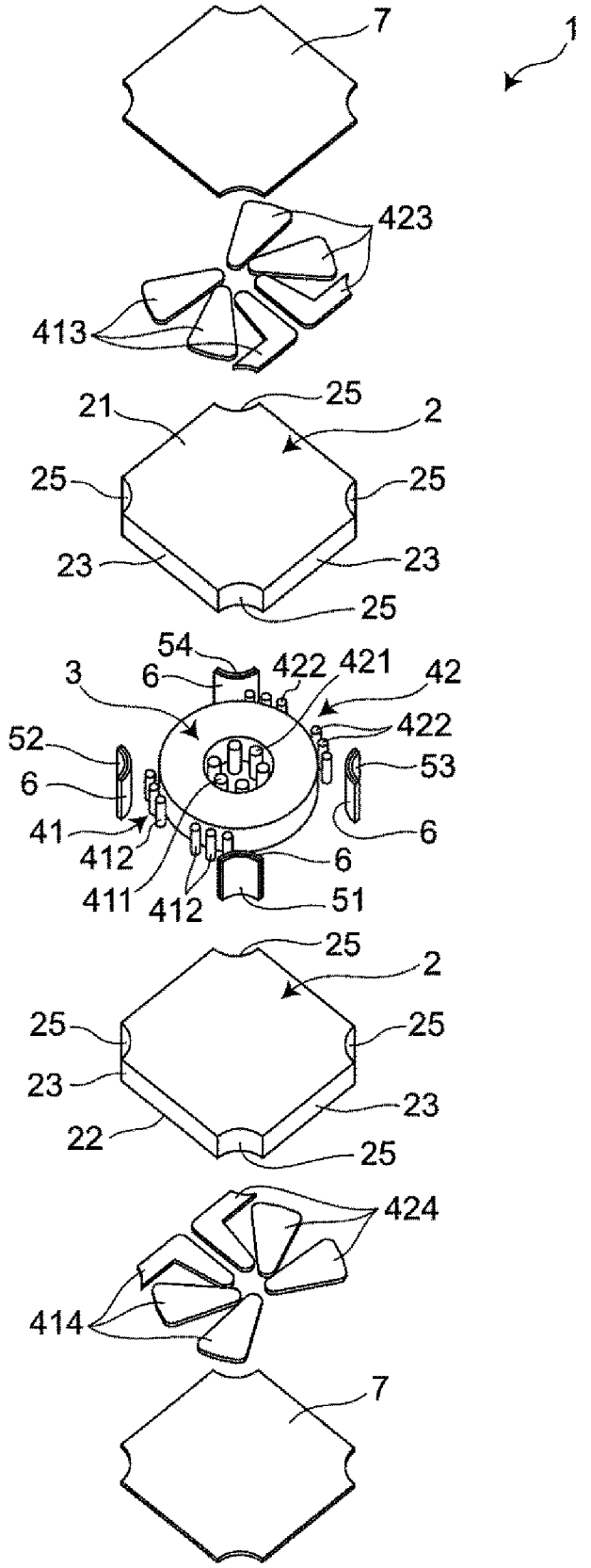
FIG. 3 is an exploded perspective view of the coil component.

FIG. 1 is a perspective view illustrating a coil component as an embodiment of the disclosure. FIG. 2 is a cross-sectional view of the coil component. FIG. 3 is an exploded perspective view of the coil component.

As illustrated in FIGS. 1, 2, and 3, a coil component 1 includes a main body portion 2, a substantially annular core 3 provided in the main body portion 2, a first coil 41 and a second coil 42 that are provided in the main body portion 2 and are wound around the core 3. The coil component 1 further includes first, second, third, and fourth outer electrodes 51, 52, 53, and 54 that are electrically connected to the first coil 41 and the second coil 42.

The main body portion 2 contains resin. A resin material is, for example, epoxy resin, but may be polyetheretherketone, polyimide, polyamide, polyetherimide, or the like. The main body portion 2 has a substantially rectangular parallelepiped shape, and the surface of the main body portion 2 is formed by a top surface 21, a bottom surface 22, and four side surfaces 23. Although the bottom surface 22 is a surface at a side along which the coil component 1 is mounted on a mounting substrate, the mounting surface may be at the top surface 21 side in terms of a symmetric property of the coil component 1.

Four recesses 25 are provided in the side surfaces 23 of the main body portion 2. The recesses 25 are provided at corner portions as portions connecting the adjacent side surfaces 23 and 23. The recesses 25 extend from the top surface 21 of the main body portion 25 toward the bottom surface 22 thereof.

The core 3 is composed of, for example, a ceramic core such as ferrite or a metal-based core. The core 3 has an upper end surface and a lower end surface which face each other in the central axis direction. The upper end surface faces the top surface 21 of the main body portion 2. The lower end surface faces the bottom surface 22 of the main body portion 2. The shape of the core 3 may be a substantially elliptical shape, a substantially rectangular shape, or a substantially polygonal shape other than a substantially circular shape in plan view. Also, the cross-sectional shape of the core 3 is not limited to a substantially rectangular shape as illustrated in the drawings, and may be a substantially circular shape, a substantially elliptical shape, or a substantially polygonal shape.

The first coil 41 and the second coil 42 are made of metal such as copper, gold, or silver, for example. The first coil 41 and the second coil 42 are arranged so as to face each other. The winding direction of the first coil 41 around the core 3 is opposite to the winding direction of the second coil 42 around the core 3. The number of turns of the first coil 41 and the number of turns of the second coil 42 are the same.

One end of the first coil 41 is connected to the first outer electrode 51, and the other end of the first coil 41 is connected to the second outer electrode 52. One end of the second coil 42 is connected to the third outer electrode 53, and the other end of the second coil 42 is connected to the fourth outer electrode 54. The coil component 1 constitutes a common mode choke coil having the first and third outer electrodes 51 and 53 as input terminals (output terminals) and the second and fourth outer electrodes 52 and 54 as output terminals (input terminals).

The first to fourth outer electrodes 51 to 54 are disposed in the respective recesses 25. Wall layers 6 are interposed between the first to fourth outer electrodes 51 to 54 and the inner surfaces of the recesses 25. The wall layers 6 have shapes substantially along the inner surfaces of the recesses 25. Specifically, the wall layers 6 are formed into substantially curved plate shapes. The wall layers 6 have, for example, substantially arc shapes obtained by cutting substantially cylindrical pipes with a center angle of 90° when viewed from an axial direction thereof. Therefore, since the wall layers 6 are not shaped to protrude to outer side portions of the coil component 1, it is possible to suppress increase in size relative to an outer size of the main body portion 2.

The first to fourth outer electrodes 51 to 54 are provided on the inner surfaces (recessed curves) of the wall layers 6. The first to fourth outer electrodes 51 to 54 are formed into substantially film shapes. The first to fourth outer electrodes 51 to 54 are made of, for example, metal such as copper, gold, or silver.

The wall layers 6 contain, for example, resin or ceramic. When the wall layers 6 contain resin, characteristics of the wall layers 6 and the main body portion 2, such as coefficients of thermal expansion, can be the same, and close contact performance between the wall layers 6 and the main body portion 2 is made preferable. When the wall layers 6 contain ceramic, characteristics of the wall layers 6 and the outer electrodes 51 to 54, such as coefficients of thermal expansion, can be approximated, and close contact performance between the wall layers 6 and the outer electrodes 51 to 54 is made preferable.

Examples of a resin material of the wall layers 6 include polyetheretherketone, polyimide, polyamide, and polyetherimide. Examples of a ceramic material of the wall layers 6 include alumina, mullite, zirconia and sialon.

With the coil component 1, when the outer electrodes 51 to 54 of the coil component 1 are fixed to the mounting substrate by solder and the bottom surface of the coil component 1 (the bottom surface 22 side of the main body portion 2) is mounted on the mounting substrate, the outer electrodes 51 to 54 are disposed in the recesses 25 in the side surfaces 23 of the main body portion 2. Therefore, the adhesion area of the solder can be secured and a fixing property can be improved. Moreover, whether or not the solder is fixed to the outer electrodes 51 to 54 can be externally checked, so that reliability of connection to the mounting substrate can be improved. Further, since the outer electrodes 51 to 54 are disposed in the recesses 25 in the side surfaces 23 of the main body portion 2, an outer diameter dimension of the coil component 1 can be reduced and the mounting area of the coil component 1 can be reduced. Therefore, it is possible to improve the reliability of the connection of the coil component 1 to the mounting substrate without increasing the mounting area of the coil component 1.

Further, since the wall layers 6 are interposed between the outer electrodes 51 to 54 and the inner surfaces of the recesses 25, roughness of the inner surfaces of the recesses 25 of the main body portion 2 can be absorbed by the wall layers 6 and the thicknesses of the outer electrodes 51 to 54 can be uniformly reduced.

Figure 4:
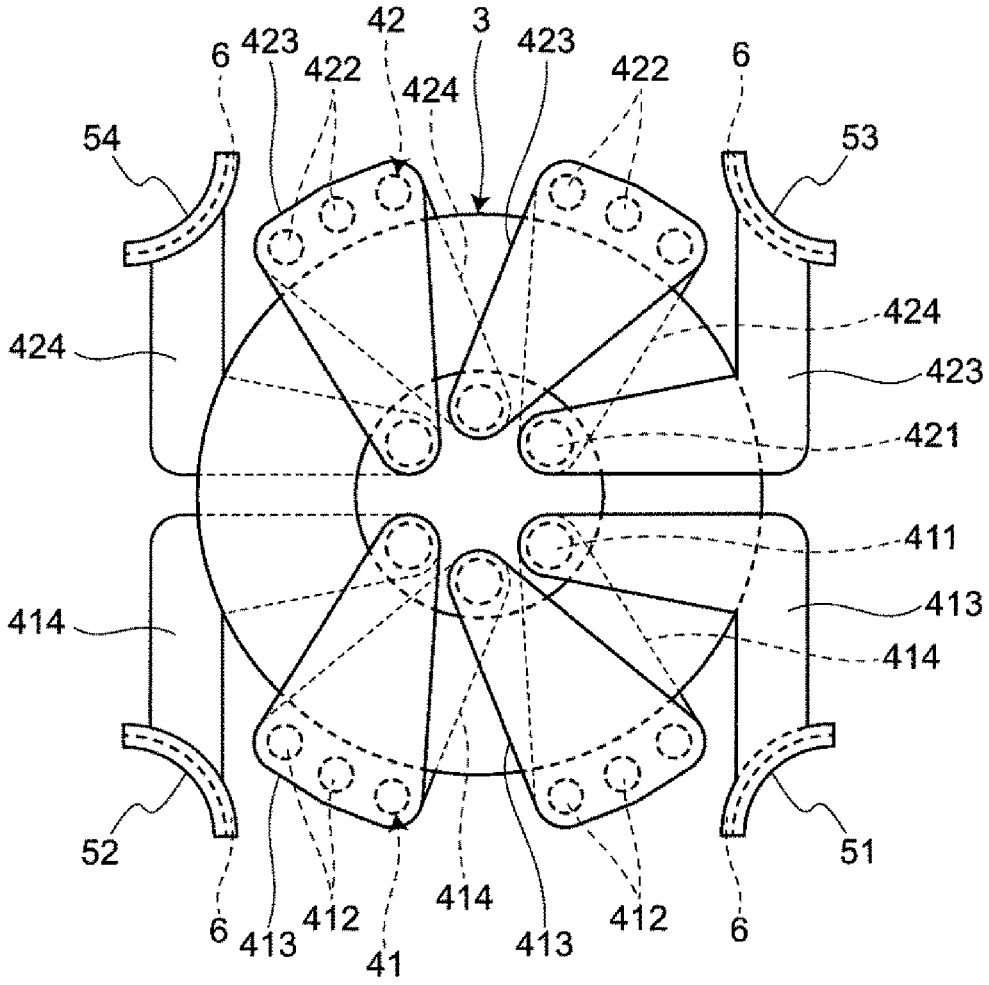
FIG. 4 is a descriptive view for explaining a connection state of a coil.

FIG. 4 is a descriptive view for explaining a connection state of the coils 41 and 42. As illustrated in FIGS. 3 and 4, a plurality of wirings 411, 412, 413, and 414 is connected to form the first coil 41.

The first wirings 411 and the second wirings 412 are substantially rod-shaped pin members and are formed substantially linearly. The first wirings 411 are arranged in inner side portions of the core 3 in the radial direction along the central axis of the core 3. The second wirings 412 are arranged in outer side portions of the core 3 in the radial direction along the central axis of the core 3. The first wirings 411 and the second wirings 412 are embedded in the main body portion 2.

The third wirings 413 and the fourth wirings 414 are formed in substantially film shapes. The third wirings 413 are arranged on the upper end surface of the core 3 along a plane orthogonal to the central axis of the core 3. The fourth wirings 414 are arranged on the lower end surface of the core 3 along a plane orthogonal to the central axis of the core 3. The third wirings 413 are exposed from the top surface 21 of the main body portion 2. The fourth wirings 414 are exposed from the bottom surface 22 of the main body portion 2. The third wirings 413 are examples of an "outer wiring exposed from the top surface of the main body portion" in the scope of the disclosure. The fourth wirings 414 are examples of an "outer wiring exposed from the bottom surface of the main body portion" in the scope of the disclosure.

One end of the third wiring 413 is connected to one end of the first wiring 411, the other end of the first wiring 411 is connected to one end of the fourth wiring 414, the other end of the fourth wiring 414 is connected to one ends of the three second wirings 412, and the other ends of the three second wirings 412 are connected to one end of another third wiring 413. By repeating this, the third wirings 413, the first wirings 411, the fourth wirings 414, and the second wirings 412 are spirally wound around the core 3. In other words, a unit element of one turn is constituted by one set of the third wirings 413, the first wiring 411, the fourth wiring 414, and the second wirings 412.

The first outer electrode 51 is connected to the third wiring 413. The first outer electrode 51 is integrally continuous with the third wiring 413. The first outer electrode 51 and the third wiring 413 are formed by, for example, plating. Thus, there is no bonding surface between the first outer electrode 51 and the third wiring 413, and disconnection of the first outer electrode 51 and the third wiring 413 can be prevented. Similarly, the second outer electrode 52 is integrally continuous with the fourth wiring 414, there is no bonding surface between the second outer electrode 52 and the fourth wiring 414, and disconnection of the second outer electrode 52 and the fourth wiring 414 can be prevented.

Similarly to the first coil 41, a plurality of wirings 421, 422, 423, and 424 is connected to form the second coil 42. In other words, the first wirings 421 are arranged in inner side portions of the core 3 in the radial direction, and the second wirings 422 are arranged in outer side portions of the core 3 in the radial direction. The third wirings 423 are arranged on the upper end surface of the core 3, and the fourth wirings 424 are arranged on the lower end surface of the core 3.

The third wirings 423, the first wirings 421, the fourth wirings 424, and the second wirings 422 are sequentially connected and spirally wound around the core 3. The third outer electrode 53 is integrally continuous with the third wiring 423, there is no bonding surface between the third outer electrode 53 and the third wiring 423, and disconnection of the third outer electrode 53 and the third wiring 423 can be prevented. The fourth outer electrode 54 is integrally continuous with the fourth wiring 424, there is no bonding surface between the fourth outer electrode 54 and the fourth wiring 424, and disconnection of the fourth outer electrode 54 and the fourth wiring 424 can be prevented.

The third wirings 413 of the first coil 41 and the third wirings 423 of the second coil 42 are covered with a protective sheet 7 at the upper side. The fourth wirings 414 of the first coil 41 and the fourth wirings 424 of the second coil 42 are covered with the protective sheet 7 at the lower side. The protective sheet 7 has an insulating property and may be insulating resin or a substrate such as glass epoxy. Therefore, it is possible to easily improve the insulating property of the wirings exposed from the main body portion 2.

Next, a method for manufacturing the coil component 1 will be described.

Figure 5A:
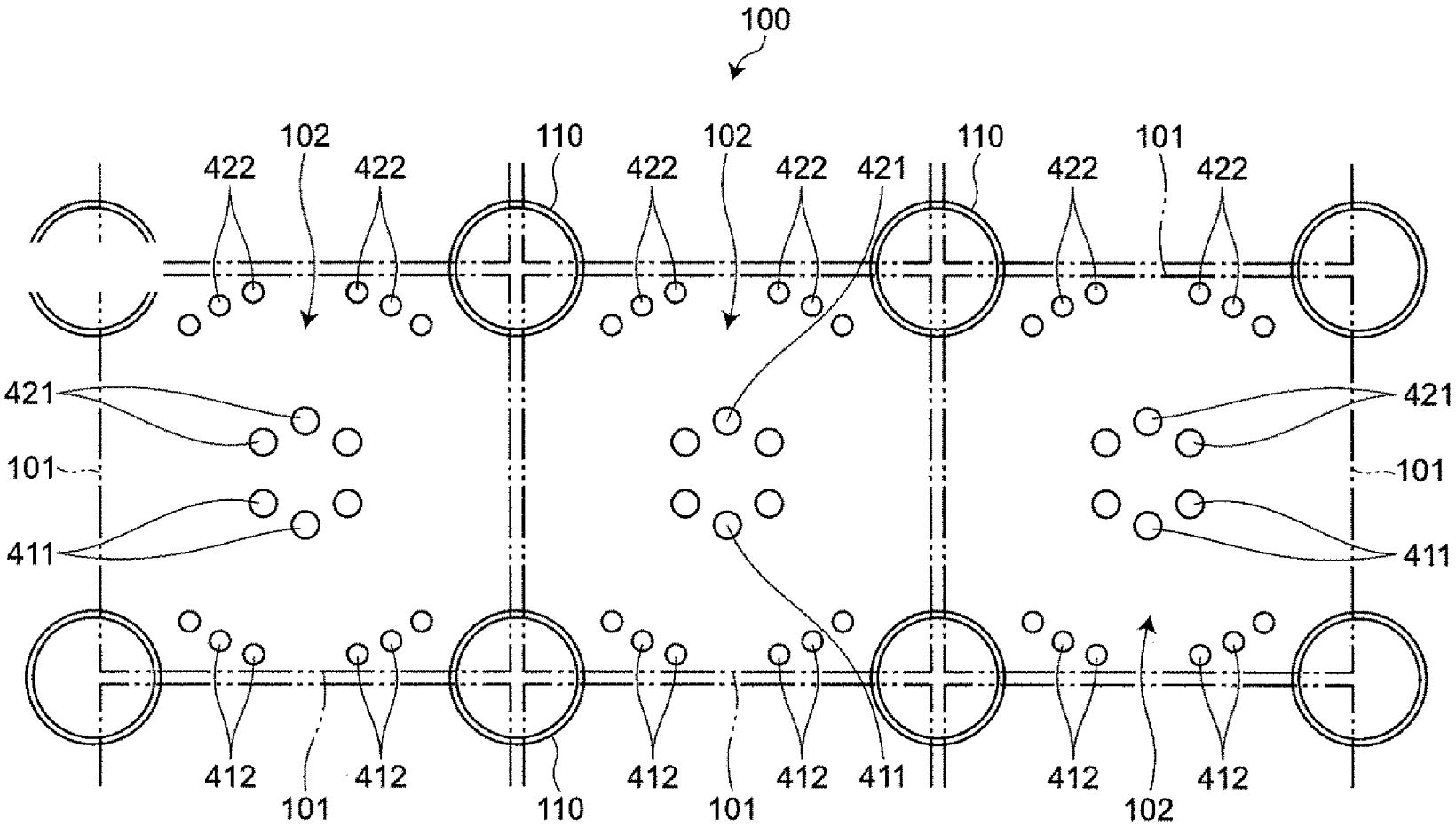
FIG. 5A is a descriptive view for explaining a method for manufacturing the coil component.

As illustrated in FIG. 5A, a plurality of regions 102 is formed on a substrate 100 containing resin. One region 102 corresponds to one coil component 1. The regions 102 are partitioned by substantially square cut lines 101. Parts of the coils 41 and 42 are arranged in each of the plurality of regions 102. In other words, the first and second wirings 411 and 412 of the first coil 41 and the first and second wirings 421 and 422 of the second coil 42 are made to stand in each region 102. Further, pipes 110 are made to stand on the cut lines 101 on the substrate 100. In other words, one pipe 110 is provided so as to straddle four regions 102. In short, the pipes 110 are arranged at four corners of each region 102.

Figure 5B:
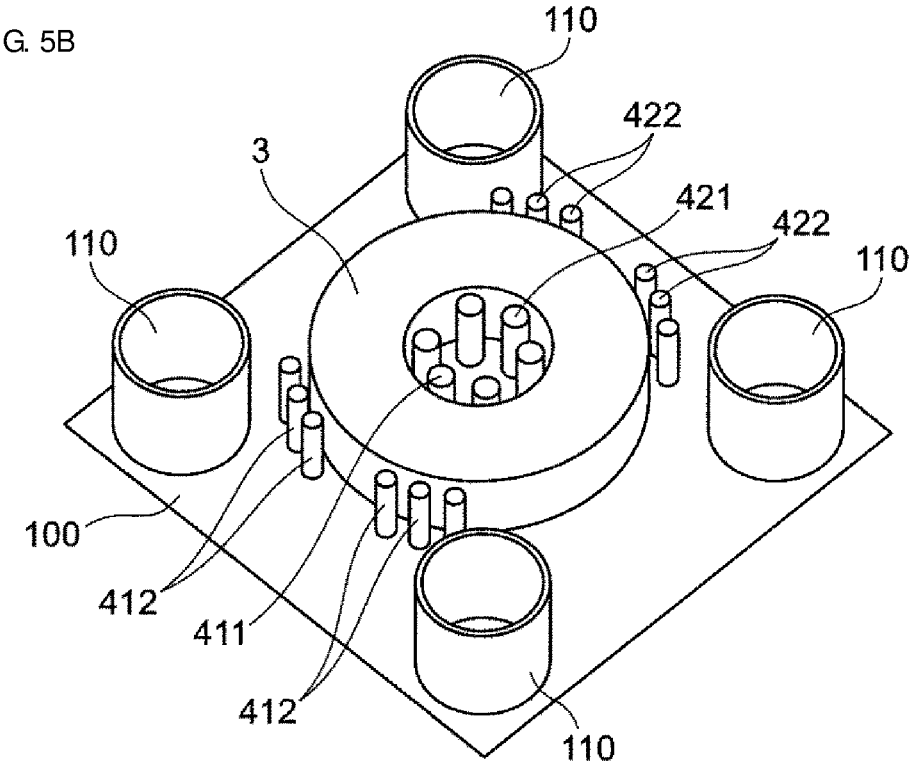
FIG. 5B is a descriptive view for explaining the method for manufacturing the coil component.

As illustrated in FIG. 5B, the core 3 is installed on the substrate 100. At this time, the first wirings 411 and 421 are arranged in the inner side portions of the core 3 in the radial direction, and the second wirings 412 and 422 are arranged in the outer side portions of the core 3 in the radial direction. In FIGS. 5B to 5E, a part of FIG. 5A is illustrated.

Figure 5C:
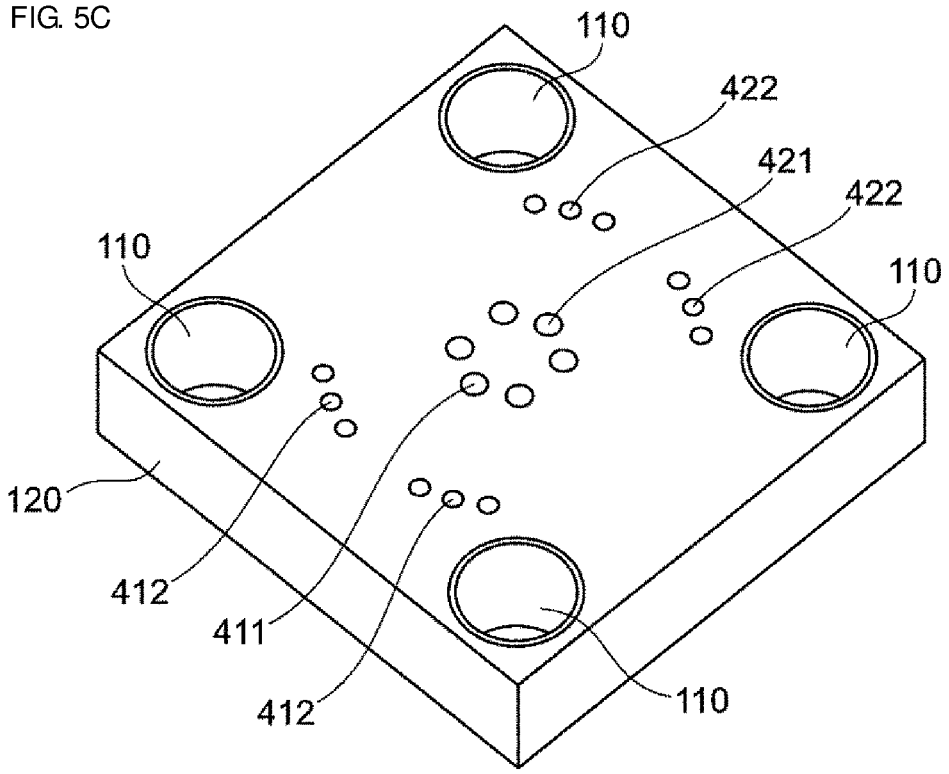
FIG. 5C is a descriptive view for explaining the method for manufacturing the coil component.

As illustrated in FIG. 5C, the coils (the first wirings 411 and 421 and the second wirings 412 and 422) on the substrate 100, the pipes 110, and the core 3 are molded with resin 120. At this time, the inner surfaces of the pipes 61, 62, and 63 are exposed. Thereafter, the front and rear surfaces are ground to provide a predetermined thickness. At this time, all portions of the substrate 100 are ground to make the end surfaces of the first wirings 411 and 421 and the second wirings 412 and 422 be exposed from the resin 120.

Figure 5D:
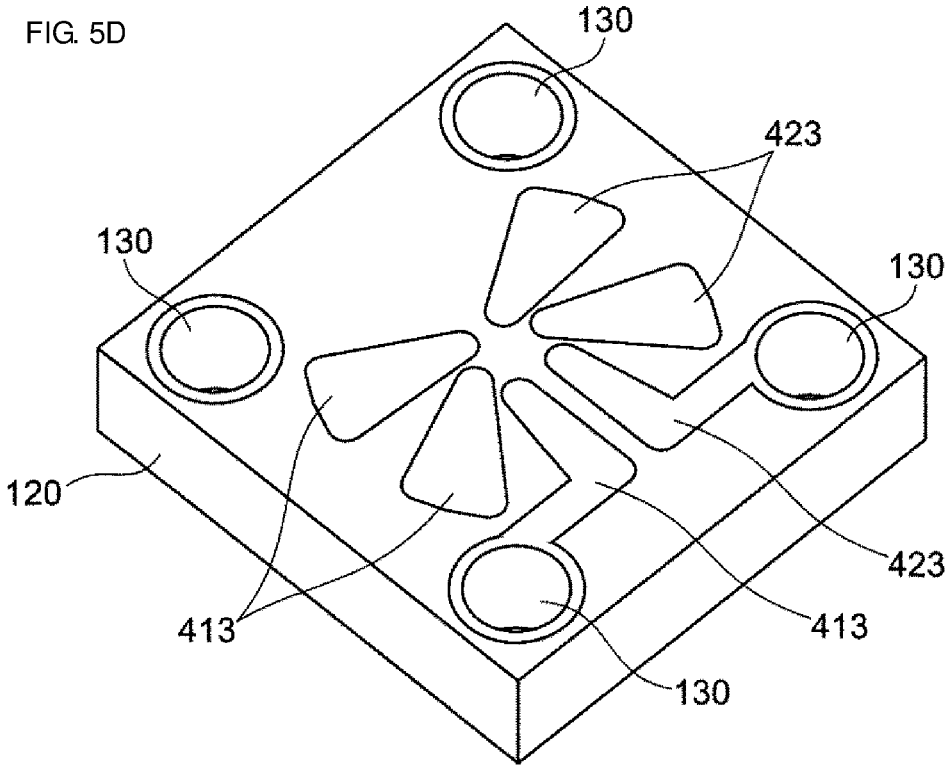
FIG. 5D is a descriptive view for explaining the method for manufacturing the coil component.

As illustrated in FIG. 5D, electrode films 130 as outer electrodes are formed in the pipes 110 by plating. At this time, parts of the coils exposed from the resin 120 (that is, the third wirings 413 and 423 and the fourth wirings 414 and 424) are formed integrally with the electrode films 130 by plating. Thus, there is no bonding surface between the parts of the coils and the electrode films 130 and disconnection of the parts of the coils and the electrode films 130 can be prevented. In addition, it is possible to make the thicknesses of the parts of the coils and the thicknesses of the electrode films 130 equal, for example, to 100 μm.

Figure 5E:
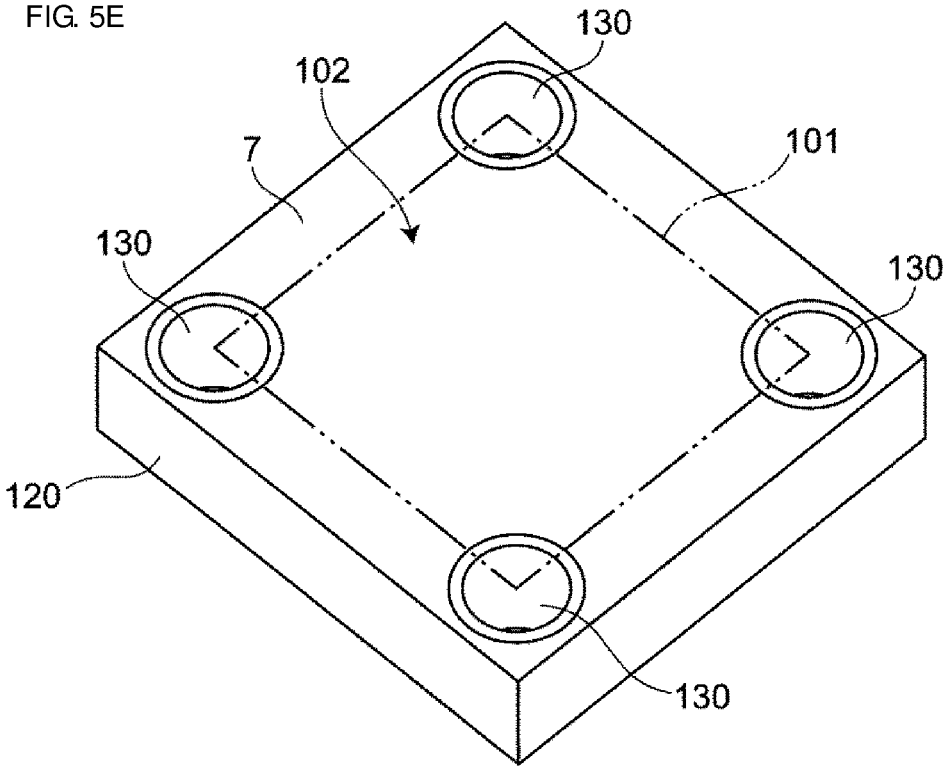
FIG. 5E is a descriptive view for explaining the method for manufacturing the coil component.

As illustrated in FIG. 5E, the protective sheets 7 are provided on the upper and lower surfaces of the resin 120 so as to cover the third wirings 413 and 423 and the fourth wirings 414 and 424. The resin 120, the pipes 110, and the electrode films 130 are cut along the cut lines 101 of the substrate 100. Thus, they are divided for the plurality of regions 102, and the electrode films 130 in the cut pipes 110 are exposed to form the outer electrodes 51 to 54 (see FIG. 1). The cut pipes 110 constitute the wall layers 6, and the cut electrode films 130 constitute the outer electrodes 51 to 54. The cut resin 120 constitutes the main body portion 2. In FIG. 5C, a part of the substrate 100 may be left without being ground, and in this case, the main body portion 2 is formed of the substrate 100 and the resin 120.

With the method for manufacturing the coil component 1, since the outer electrodes 51 to 54 can be disposed in the recesses 25 in the side surfaces 23 of the main body portion 2, the reliability of connection of the coil component 1 to the mounting substrate can be improved without increasing the mounting area of the coil component 1. Further, since the wall layers 6 can be interposed between the outer electrodes 51 to 54 and the inner surfaces of the recesses 25, the roughnesses of the inner surfaces of the recesses 25 of the main body portion 2 can be absorbed by the wall layers 6, and the thicknesses of the outer electrodes 51 to 54 can be uniformly reduced.

In addition, since the electrode films 130 are formed by plating in the pipes 110, the outer electrodes 51 to 54 in the plurality of regions 102 can be formed at a time and manufacturing time can be shortened. Further, since the pipes 110 are cut along the cut lines 101 on the substrate 100 and the electrode films 130 in the cut pipes 110 are exposed to form the outer electrodes 51 to 54, the pipes 110 and the electrode films 130 are thin and stress at the time of cutting can be reduced. On the other hand, when solid electrode rods are used instead of the pipes 110, the stress at the time of cutting increases.

Further, since one pipe 110 is provided so as to straddle the four regions 102, the outer electrodes of the four coil components 1 can be formed by one pipe 110. In addition, the outer electrodes 51 to 54 can be provided at the four corners of the coil component 1. Note that the outer electrodes may be provided not at the four corners of the coil component 1 but on the sides of the coil component 1. In this case, one pipe 110 may be provided so as to straddle the sides of two regions 102.

Note that the present disclosure is not limited to the above-described embodiment, and design changes can be made without departing from the gist of the present disclosure.

In the above embodiment, the number of coils is two, but may be one or equal to or more than three. Further, the number of outer electrodes may be increased or decreased depending on the number of coils.

In the above embodiment, the first and second wirings of the coils are the substantially rod-shaped pin members, but may be pin members bent in substantially U shapes. Also, the coils may be formed of pin members, the coils may be formed of wires, or the coils may be formed of flat plates.

In the above embodiment, the wall layers have the substantially arc shapes in plan view, but the wall layers may have substantially L shapes in plan view.

In the above embodiment, the coils include the outer wirings (third and fourth wirings) exposed from the top surface and the bottom surface of the main body portion and the outer electrodes and the outer wirings are integrally continuous. Alternatively, the coils may include outer wirings exposed from one of the top surface and the bottom surface of the main body portion, and the outer electrodes and the outer wirings may be integrally continuous.

Although the core is provided in the above embodiment, the core may be omitted. In this case, for example, magnetic powder may be mixed in the main body portion.

In the above embodiment, the outer electrodes and the wall layers have the substantially arc shapes obtained by cutting the substantially cylindrical pipes with the center angle of 90° when viewed from the axial direction thereof, but may have shapes obtained by cutting them with any other center angle or may have shapes obtained by cutting substantially polygonal shapes with an arbitrary center angle instead of the substantially arc shapes.

In the above embodiment, the first and second wirings of the coils are embedded in the main body portion, but may be formed on the inner surfaces of the substantially cylindrical pipes provided in the main body portion.

While some embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A coil component comprising:

a main body portion containing resin, and a plurality of recesses extending from a top surface of the main body portion toward a bottom surface are provided in side surfaces of the main body portion;

a coil provided in the main body portion; and an outer electrode electrically connected to the coil, the outer electrode being disposed in a recess of the plurality of recesses, and a wall layer is interposed between the outer electrode and an inner surface of the recess, wherein each of the plurality of recesses is provided in each of respective corner portions connecting respective adjacent side surfaces of the main body portion, each of the plurality of recesses extends entirely from the top surface of the main body to the bottom surface of the main body, and the outer electrode extends entirely from the top surface of the main body to the bottom surface of the main body, and the wall layer extends entirely from the top surface of the main body to the bottom surface of the main body.

2. The coil component according to claim 1, wherein the wall layer is substantially shaped along the inner surface of the recess.

3. The coil component according to claim 2, wherein the wall layer contains resin.

4. The coil component according to claim 2, wherein the wall layer contains ceramic.

5. The coil component according to claim 2, wherein the coil includes an outer wiring exposed from at least one of a top surface and a bottom surface of the main body portion, and the outer electrode and the outer wiring are integrally continuous.

6. The coil component according to claim 5, further including an insulating protective sheet covering the outer wiring.

7. The coil component according to claim 2, further comprising:

a substantially annular core provided in the main body portion, and wherein the coil is wound around the core.

8. The coil component according to claim 1, wherein the wall layer contains resin.

9. The coil component according to claim 8, wherein the coil includes an outer wiring exposed from at least one of a top surface and a bottom surface of the main body portion, and the outer electrode and the outer wiring are integrally continuous.

10. The coil component according to claim 8, further comprising:

a substantially annular core provided in the main body portion, and wherein the coil is wound around the core.

11. The coil component according to claim 1, wherein the wall layer contains ceramic.

12. The coil component according to claim 11, wherein the coil includes an outer wiring exposed from at least one of a top surface and a bottom surface of the main body portion, and the outer electrode and the outer wiring are integrally continuous.

13. The coil component according to claim 11, further comprising:

a substantially annular core provided in the main body portion, and wherein the coil is wound around the core.

14. The coil component according to claim 1, wherein the coil includes an outer wiring exposed from at least one of a top surface and a bottom surface of the main body portion, and the outer electrode and the outer wiring are integrally continuous.

15. The coil component according to claim 14, further including an insulating protective sheet covering the outer wiring.

16. The coil component according to claim 15, further comprising:

a substantially annular core provided in the main body portion, and wherein the coil is wound around the core.

17. The coil component according to claim 14, further comprising:

a substantially annular core provided in the main body portion, and wherein the coil is wound around the core.

18. The coil component according to claim 1, further comprising:

a substantially annular core provided in the main body portion, and wherein the coil is wound around the core.

* * * * *